US011058226B2

(12) United States Patent
Hsu et al.

(10) Patent No.: US 11,058,226 B2
(45) Date of Patent: Jul. 13, 2021

(54) RECESSED AIR PUMP

(71) Applicant: Intex Marketing Ltd., Tortola (VG)

(72) Inventors: Yaw Yuan Hsu, Fujian (CN); Zhi Xiong Huang, Fujian (CN)

(73) Assignee: Intex Marketing Ltd., Tortola (VG)

( * ) Notice: Subject to any disclaimer, the term of this patent is extended or adjusted under 35 U.S.C. 154(b) by 447 days.

(21) Appl. No.: 15/836,336

(22) Filed: Dec. 8, 2017

(65) Prior Publication Data

US 2018/0160820 A1 Jun. 14, 2018

(30) Foreign Application Priority Data

Dec. 8, 2016 (CN) ..... 201621344003.8

(51) Int. Cl.

| | |
|---|---|
| ***A47C 27/08*** | (2006.01) |
| ***F04B 39/12*** | (2006.01) |
| ***F04B 35/04*** | (2006.01) |

(52) U.S. Cl.

CPC ..... *A47C 27/082* (2013.01); *A47C 27/087* (2013.01); *F04B 35/04* (2013.01); *F04B 39/12* (2013.01); *F04B 39/121* (2013.01); *F04B 39/123* (2013.01)

(58) Field of Classification Search

CPC ..... A47C 27/08; A47C 27/081; A47C 27/082; A47C 27/087; F04B 39/123; F04B 39/12; F04B 39/121; F04B 35/04

See application file for complete search history.

(56) References Cited

U.S. PATENT DOCUMENTS

| | | | |
|---|---|---|---|
| 10,139 | A | 10/1853 | Scott |
| 28,150 | A | 5/1860 | Broad |
| 66,706 | A | 7/1867 | Hamilton |
| 151,400 | A | 5/1874 | Keeler et al. |
| 187,397 | A | 2/1877 | Macintosh et al. |
| 277,979 | A | 5/1883 | Blochman et al. |
| 388,037 | A | 8/1888 | Hargin |
| 486,696 | A | 11/1892 | Curlin |
| 585,834 | A | 7/1897 | Ruth |
| 795,108 | A | 7/1905 | Doellinger |
| 1,772,310 | A | 8/1930 | Hart |
| 2,437,006 | A | 3/1948 | Simpson |
| 2,493,067 | A | 1/1950 | Goldsmith |
| 2,684,672 | A | 7/1954 | Summerville |
| 2,690,295 | A | 9/1954 | Rand |
| 2,698,028 | A | 12/1954 | Lee et al. |
| 2,719,986 | A | 10/1955 | Rand |
| 2,926,836 | A | 3/1960 | Marsh et al. |

(Continued)

FOREIGN PATENT DOCUMENTS

| | | |
|---|---|---|
| CN | 1519476 | 8/2004 |
| CN | 1260478 | 6/2006 |

(Continued)

*Primary Examiner* — David R Hare

(74) *Attorney, Agent, or Firm* — Faegre Drinker Biddle & Reath LLP

(57) ABSTRACT

A pump is disposed within an inflatable chamber of an inflatable bed. The pump is recessed within the inflatable chamber and is offset from a faceplate, which in turn is connected to a portion of the inflatable bed. This arrangement results in less strain applied onto a peripheral panel of the inflatable chamber thereby maintaining the structural integrity of the inflatable bed.

22 Claims, 12 Drawing Sheets

(56) References Cited

U.S. PATENT DOCUMENTS 3,068,494 A 12/1962 Pinkwater
3,112,502 A 12/1963 Forsberg
3,155,991 A 11/1964 Dunham
3,388,701 A 6/1968 Schreiber et al.
3,462,778 A 8/1969 Whitney
3,485,240 A 12/1969 Fountain
3,653,083 A 4/1972 Lapidus
4,193,149 A 3/1980 Welch
4,197,837 A 4/1980 Tringali et al.
4,225,989 A * 10/1980 Corbett ..... A61G 7/05776 5/710
4,390,226 A 6/1983 Hohn
4,394,784 A 7/1983 Swenson et al.
4,504,989 A 3/1985 Maltz
4,579,141 A 4/1986 Arff
4,583,255 A 4/1986 Mogaki et al.
4,619,481 A 10/1986 Grudzinskas
4,638,519 A 1/1987 Hess
4,678,014 A 7/1987 Owen et al.
4,702,235 A 10/1987 Hong
4,711,275 A 12/1987 Ford et al.
4,766,628 A 8/1988 Walker
4,768,249 A 9/1988 Goodwin
4,829,616 A 5/1989 Walker
4,862,533 A 9/1989 Adams, III
4,890,344 A 1/1990 Walker
4,897,890 A 2/1990 Walker
4,930,174 A 6/1990 Hunter
4,938,528 A 7/1990 Scott
4,944,060 A 7/1990 Peery et al.
4,945,588 A 8/1990 Cassidy et al.
4,977,633 A 12/1990 Chaffee
5,013,518 A 5/1991 Nielinger et al.
5,020,176 A 6/1991 Dotson
5,020,517 A 6/1991 Foster, Jr. et al.
5,044,029 A 9/1991 Vrzalik
5,057,819 A 10/1991 Valenti
5,068,933 A 12/1991 Sexton
5,127,808 A 7/1992 Nichols et al.
5,142,717 A 9/1992 Everard et al.
5,152,579 A 10/1992 Bishai
5,170,522 A 12/1992 Walker
5,189,742 A 3/1993 Schild
5,216,778 A 6/1993 Suzuki et al.
5,232,353 A 8/1993 Grant
5,235,713 A 8/1993 Guthrie et al.
5,249,319 A * 10/1993 Higgs ..... A47C 27/082 5/713
5,267,363 A * 12/1993 Chaffee ..... A47C 27/081 417/38
5,297,545 A 3/1994 Infante
5,325,551 A 7/1994 Tappel et al.
5,349,983 A 9/1994 Ozarowski et al.
5,367,726 A 11/1994 Chaffee
5,450,638 A 9/1995 Johnson
5,467,543 A 11/1995 Fink et al.
5,503,618 A 4/1996 Rey
5,509,154 A 4/1996 Shafer et al.
5,522,337 A 6/1996 Meyers et al.
5,529,377 A 6/1996 Miller
5,542,136 A 8/1996 Tappel
5,564,963 A 10/1996 Chan
5,584,084 A 12/1996 Klearman et al.
5,586,347 A 12/1996 Frischknecht
5,605,482 A 2/1997 Choy
5,606,756 A 3/1997 Price
5,611,772 A 3/1997 Fujimoto et al.
5,652,484 A 7/1997 Shafer et al.
5,687,439 A 11/1997 Wagner
5,696,756 A 12/1997 Fujimoto et al.
5,711,041 A 1/1998 Chen
5,716,199 A 2/1998 Shan-Chieh
5,771,514 A 6/1998 Wilhoit
5,794,289 A 8/1998 Wortman et al.
5,827,052 A 10/1998 Wang
5,848,875 A 12/1998 San-Jou
5,876,359 A 3/1999 Bock et al.
5,890,882 A 4/1999 Feldman
5,898,958 A 5/1999 Hall
5,903,941 A 5/1999 Shafer et al.
5,904,172 A 5/1999 Gifft et al.
5,931,207 A 8/1999 Gianino
5,941,272 A 8/1999 Feldman
5,944,494 A 8/1999 Soltani et al.
5,947,168 A 9/1999 Viard
5,970,550 A 10/1999 Gazes
6,004,116 A 12/1999 Wang
6,007,667 A 12/1999 Wang
6,014,784 A 1/2000 Taylor et al.
6,018,960 A 2/2000 Parienti
6,032,080 A 2/2000 Brisbane et al.
6,037,723 A 3/2000 Shafer et al.
6,058,537 A 5/2000 Larson
6,119,292 A 9/2000 Haas
6,120,264 A 9/2000 Wang
6,152,176 A 11/2000 Lin
6,158,082 A 12/2000 Beckey et al.
6,185,770 B1 2/2001 Wang
6,206,654 B1 3/2001 Cassidy
6,212,718 B1 4/2001 Stolpmann et al.
6,237,621 B1 5/2001 Chaffee
6,237,653 B1 5/2001 Chaffee
6,253,401 B1 7/2001 Boyd
6,266,833 B1 7/2001 Lin
6,267,739 B1 7/2001 Cengarle
6,287,095 B1 * 9/2001 Saputo ..... A47C 27/081 417/472
6,312,400 B1 11/2001 Itikawa et al.
6,315,526 B1 11/2001 Jones
6,321,400 B1 11/2001 Gulino
6,332,760 B1 * 12/2001 Chung ..... F04D 25/084 417/239
6,447,361 B1 9/2002 Akiyama
6,457,192 B2 10/2002 Choi et al.
6,483,264 B1 11/2002 Shafer et al.
RE37,983 E 2/2003 Wang
6,543,073 B2 * 4/2003 Wu ..... A47C 7/021 5/655.3
6,564,411 B2 5/2003 Pirzada
6,571,825 B2 6/2003 Stacy
6,591,437 B1 7/2003 Phillips
6,598,626 B2 7/2003 Chaffee
6,651,283 B1 11/2003 Cook et al.
6,679,686 B2 1/2004 Wang
6,686,711 B2 2/2004 Rose et al.
6,698,046 B1 3/2004 Wu
6,718,584 B2 4/2004 Rabaiotti et al.
6,722,306 B1 4/2004 Wang
6,733,254 B1 5/2004 Yen
6,755,208 B2 6/2004 Chaffee
6,763,541 B2 7/2004 Mahoney et al.
6,793,469 B2 9/2004 Chung
6,800,165 B2 10/2004 Wang
6,832,629 B2 12/2004 Wu
6,832,630 B2 12/2004 Wu
6,836,914 B1 * 1/2005 Tsai ..... A47C 27/082 5/655.3
6,928,681 B1 8/2005 Stacy
6,964,134 B2 11/2005 Chaffee
6,986,360 B2 1/2006 Chaffee
6,990,700 B2 1/2006 Chung
7,000,276 B2 2/2006 Chaffee
7,020,921 B2 4/2006 Wang
7,025,576 B2 4/2006 Chaffee
7,028,358 B2 4/2006 Liu
7,036,171 B2 5/2006 Wu
7,039,972 B2 * 5/2006 Chaffee ..... A47C 27/082 5/706
7,040,347 B2 5/2006 Wang
7,114,207 B2 10/2006 Wang
7,120,955 B2 10/2006 Wang
7,127,762 B1 * 10/2006 Lau ..... A47C 27/082 5/713
RE39,408 E 11/2006 Wang

(56) References Cited

U.S. PATENT DOCUMENTS 7,141,101 B2 11/2006 Amann
7,152,265 B2 12/2006 Chung
7,198,076 B2 4/2007 Wu
7,210,902 B2 5/2007 Song et al.
7,225,488 B2 6/2007 Wu
7,246,394 B2 7/2007 Wang
7,284,291 B2 * 10/2007 Wang ..... A47C 27/081 5/711
7,284,968 B2 10/2007 Tsai
7,296,315 B2 11/2007 Totton et al.
7,306,694 B2 12/2007 Wang
7,313,837 B2 1/2008 Wang
7,322,801 B2 1/2008 Li et al.
7,328,472 B2 2/2008 Chaffee
7,346,944 B2 3/2008 Shaw
7,346,950 B2 3/2008 Chung
7,380,301 B2 6/2008 Chung
7,406,736 B2 8/2008 Flick
7,412,738 B2 8/2008 Chaffee
7,424,760 B2 9/2008 Chaffee
7,426,766 B2 9/2008 Gammons
7,434,283 B2 10/2008 Wilkinson et al.
7,444,704 B2 11/2008 Phillips et al.
7,475,440 B2 1/2009 Chaffee
7,509,698 B2 3/2009 Poulos
7,571,500 B2 * 8/2009 Wu ..... A47C 27/082 141/197
7,587,776 B2 9/2009 Poulos
7,588,425 B2 * 9/2009 Chung ..... A47C 27/082 417/315
7,597,123 B2 10/2009 Wang
7,644,724 B2 1/2010 Chaffee
7,648,392 B2 1/2010 Chambers et al.
7,739,763 B2 6/2010 Wang et al.
7,784,131 B2 8/2010 Genaro et al.
7,784,132 B2 8/2010 Gonzalez et al.
7,789,194 B2 9/2010 Lathrop et al.
7,805,785 B2 10/2010 Rawls-Meehan
7,877,829 B2 2/2011 Gonzalez et al.
7,886,386 B2 2/2011 Balonick et al.
7,922,461 B2 4/2011 Wang
7,938,138 B2 5/2011 Chaffee
RE42,559 E 7/2011 Wang
7,979,169 B2 7/2011 Rawls-Meehan
8,016,572 B2 9/2011 Chaffee
8,024,830 B2 9/2011 Wang et al.
8,031,080 B2 10/2011 Price et al.
8,032,263 B2 10/2011 Rawls-Meehan
8,032,960 B2 10/2011 Rawls-Meehan
8,033,800 B2 10/2011 Pan
8,046,117 B2 10/2011 Rawls-Meehan
8,051,517 B2 11/2011 Wang et al.
8,052,630 B2 11/2011 Kloecker et al.
8,078,336 B2 12/2011 Rawls-Meehan
8,078,337 B2 12/2011 Rawls-Meehan
8,087,113 B2 1/2012 Roff et al.
8,104,126 B2 1/2012 Caminade et al.
8,125,318 B2 2/2012 Heimbrock et al.
8,151,390 B2 4/2012 Wang et al.
8,156,589 B2 4/2012 Liu et al.
8,157,535 B2 4/2012 Wang et al.
8,162,009 B2 4/2012 Chaffee
8,176,588 B2 5/2012 Lin
8,210,834 B2 7/2012 Tsai
8,214,953 B2 7/2012 Wang
8,216,290 B2 7/2012 Shawver et al.
8,225,444 B2 7/2012 Chaffee
8,235,684 B2 * 8/2012 Song ..... A47C 27/082 417/315
8,297,309 B2 10/2012 Wang
8,307,841 B2 11/2012 Chaffee
8,336,369 B2 12/2012 Mahoney
8,413,278 B2 4/2013 Chaffee
8,413,674 B2 4/2013 Chaffee
8,434,177 B2 5/2013 Chaffee
8,549,686 B2 10/2013 Wang et al.
8,561,230 B2 10/2013 Shaw
8,641,391 B2 2/2014 Pan
8,656,539 B1 2/2014 Boyd
8,678,006 B2 3/2014 Porter, III
8,678,007 B2 3/2014 Porter, III
8,682,457 B2 3/2014 Rawls-Meehan
8,684,030 B2 4/2014 Chaffee
8,720,120 B2 5/2014 Chaffee
8,745,796 B2 6/2014 Liu
8,769,747 B2 7/2014 Mahoney et al.
8,776,293 B2 7/2014 Chaffee
8,801,392 B2 8/2014 Wang et al.
8,826,478 B2 9/2014 Chaffee
8,832,886 B2 9/2014 Riley et al.
8,839,473 B1 9/2014 Catala
8,839,474 B2 9/2014 Chaffee
8,863,771 B2 10/2014 Wang et al.
8,893,339 B2 11/2014 Fleury et al.
8,894,390 B2 11/2014 Hsu
8,905,981 B2 12/2014 Budig et al.
8,910,331 B2 12/2014 Wang et al.
8,931,329 B2 1/2015 Mahoney
8,966,689 B2 3/2015 McGuire et al.
9,022,051 B2 5/2015 Chaffee
9,061,765 B2 6/2015 Vazquez et al.
9,062,668 B2 6/2015 Wang et al.
9,086,162 B2 7/2015 Chaffee
9,114,048 B2 8/2015 Takeda et al.
9,121,519 B2 9/2015 Wang et al.
9,157,433 B2 10/2015 Wang et al.
9,186,589 B2 11/2015 Anastasia
9,211,018 B2 12/2015 Wang
9,211,019 B2 12/2015 Driscoll, Jr. et al.
9,279,430 B2 3/2016 Chaffee
9,279,510 B2 3/2016 Chaffee
9,289,073 B2 3/2016 Chaffee
9,295,336 B2 3/2016 Driscoll, Jr. et al.
9,314,105 B2 4/2016 Ralws-Meehan
9,364,386 B2 6/2016 Siegner
9,395,076 B2 7/2016 Wang et al.
9,737,153 B2 8/2017 Chaffee
9,752,693 B2 9/2017 Chaffee
9,759,338 B2 9/2017 Chaffee
9,803,747 B2 10/2017 Chaffee
2001/0044969 A1 11/2001 Chaffee
2003/0159218 A1 8/2003 Lin et al.
2003/0215340 A1 11/2003 Chung
2004/0037717 A1 2/2004 Wang
2005/0044631 A1 * 3/2005 Wang ..... A47C 20/048 5/615
2005/0079077 A1 4/2005 Tsai et al.
2006/0117488 A1 6/2006 Hung et al.
2006/0162779 A1 7/2006 Chaffee
2006/0204361 A1 9/2006 Xie
2006/0222535 A1 10/2006 Liu
2007/0033738 A1 2/2007 Tu
2008/0087342 A1 * 4/2008 Wang ..... F04D 25/082 137/624.27
2008/0201857 A1 8/2008 Kelly
2010/0014993 A1 * 1/2010 Wang ..... A47C 27/082 417/315
2010/0089458 A1 4/2010 Chaffee
2010/0247337 A1 9/2010 Tsai
2010/0247356 A1 9/2010 Tsai
2011/0073202 A1 3/2011 Feingold et al.
2011/0173758 A1 7/2011 Fontaine
2011/0314612 A1 12/2011 Hsu
2012/0304391 A1 12/2012 Driscoll, Jr. et al.
2013/0134764 A1 5/2013 Groh
2014/0090176 A1 4/2014 Boyd
2014/0188285 A1 7/2014 Rawls-Meehan
2014/0250597 A1 9/2014 Chen et al.
2014/0259434 A1 9/2014 Nunn et al.
2014/0277611 A1 9/2014 Nunn et al.
2014/0298589 A1 10/2014 Bailey
2014/0366957 A1 12/2014 Wang et al.
2015/0026896 A1 1/2015 Fleury et al.
2015/0082547 A1 3/2015 Boyd

(56) References Cited

U.S. PATENT DOCUMENTS

| | | | |
|---|---|---|---|
| 2015/0082548 | A1 | 3/2015 | Boyd |
| 2015/0135444 | A1 | 5/2015 | Spahn et al. |
| 2015/0157137 | A1 | 6/2015 | Nunn et al. |
| 2015/0164236 | A1 | 6/2015 | Driscoll, Jr. et al. |
| 2015/0182033 | A1 | 7/2015 | Brosnan et al. |
| 2015/0265056 | A1 | 9/2015 | Wang et al. |
| 2015/0308454 | A1 | 10/2015 | Shi |
| 2015/0374137 | A1 | 12/2015 | Mahoney et al. |
| 2016/0106620 | A1 | 4/2016 | Uno et al. |
| 2016/0120331 | A1 | 5/2016 | Wang et al. |
| 2016/0123349 | A1 | 5/2016 | Wang et al. |
| 2016/0215780 | A1 | 7/2016 | Liu |
| 2016/0238000 | A1 | 8/2016 | Suarez |
| 2017/0274396 | A1 | 9/2017 | Wang et al. |
| 2017/0280884 | A1 | 10/2017 | Liu |

FOREIGN PATENT DOCUMENTS

| | | |
|---|---|---|
| CN | 201091399 | 7/2008 |
| CN | 205434304 | 8/2016 |
| DE | 1909938 | 2/1969 |
| DE | 29721150 | 2/1998 |
| DE | 202012002366 | 6/2012 |
| DE | 202014100140 | 4/2014 |
| DE | 202014102362 | 10/2014 |
| GB | 959103 | 5/1964 |
| GB | 2428751 | 2/2007 |
| JP | 51141118 | 12/1976 |
| JP | H0467428 | 6/1992 |
| JP | H0584123 | 4/1993 |
| JP | H0754781 | 2/1995 |
| JP | H0938153 | 2/1997 |
| JP | 2000197672 | 7/2000 |
| WO | WO02/15835 | 2/2002 |
| WO | WO2017/064553 | 4/2017 |

* cited by examiner

RECESSED AIR PUMP

CROSS REFERENCE TO RELATED APPLICATIONS

This application claims priority to the following Chinese patent application, the disclosure of which is hereby expressly incorporated by reference herein in its entirety:

| Application No. | Filing Date |
|---|---|
| CN 201621344003.8 | Dec. 8, 2016 |

FIELD OF THE DISCLOSURE

The present disclosure relates to inflatable bed structures. More particularly, the present disclosure relates to a recessed pump for an inflatable bed structures.

BACKGROUND OF THE DISCLOSURE

To enhance the comfort level of inflatable beds, existing inflatable beds are increasingly thick resulting in larger and higher inflation chambers. Larger inflation chambers require a greater amount of power from the included inflation pump. A conventional inflation pump may be integrated on a sidewall or peripheral panel of an inflatable bed by fusion welding. In this case, the peripheral panel deforms under the weight of the pump when the bed is fully inflated. When the volume of the inflation pump is larger, a greater amount of strain is applied to the peripheral panel and the peripheral panel is likely to experience greater deformation. In long-term or heavy-duty service, some inflatable beds may become damaged at the fusion-welded part, causing an air leak of the bed.

For inflation pumps integrated into an inflatable structure during production, if an inflatable bed is found to be damaged after fusion welding of the inflation pump to the bed, it is inconvenient to replace due to the structure of the pump within the inflatable bed. Thus, inevitable defects in production can substantially reduce overall production efficiency. In addition, loud noise may be produced during inflation of inflatable beds by existing inflation pumps.

Improvements in the foregoing are desired.

SUMMARY

The present disclosure provides a pump that is disposed within an inflatable chamber of an inflatable bed. The pump is recessed within the inflatable chamber and is offset from a faceplate, which in turn is connected to a portion of the inflatable bed. This arrangement results in less strain applied onto a peripheral panel of the inflatable chamber thereby maintaining the structural integrity of the inflatable bed.

In one form thereof, the present disclosure provides an inflatable product assembly comprising: an inflatable product having a pair of spaced-apart panels and a peripheral panel joining the spaced-apart panels; an assembly comprising: an inflation pump recessed within the inflatable product and spaced away from the peripheral panel; and a connecting assembly coupled to the inflation pump and to the peripheral panel; and a support device coupled to one of the pair of spaced-apart panels and coupled to the inflation pump, the support device configured to support at least a portion of the weight of the inflation pump.

In another form thereof, the present disclosure provides an inflatable product assembly comprising: an inflatable product comprising a lower sheet, an upper sheet spaced from the lower sheet, and a peripheral panel joining the upper and lower sheets to define a main air chamber, the lower sheet including an upper layer, a lower layer, and a secondary air chamber defined between the upper layer and the lower layer; an assembly comprising: an inflation pump coupled to the upper layer of the lower sheet and recessed within the main air chamber and spaced away from the peripheral panel; and a bent connecting assembly coupled to the inflation pump at a first end and to the peripheral panel at a second end opposite the first end.

In yet another form thereof, the present disclosure provides an inflatable product assembly, comprising: an inflatable product including: an upper sheet; a lower sheet; and a peripheral panel coupling the upper sheet and the lower sheet and defining an inflatable chamber; an assembly comprising: an inflation pump recessed within the inflatable chamber and spaced away from the peripheral panel; and a connecting assembly coupled to the inflation pump and coupled to the peripheral panel of the inflatable product, the connecting assembly defining an air pathway between the peripheral panel and the inflation pump.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
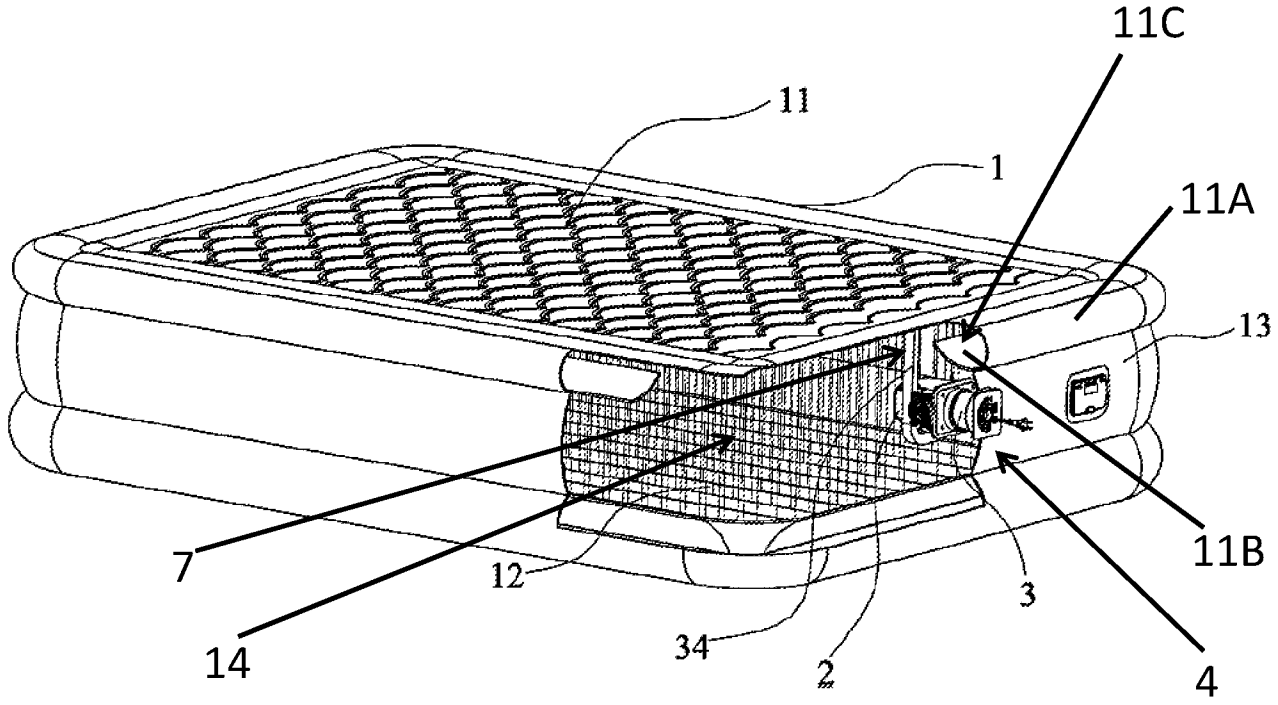
FIG. 1 is a perspective view of an inflatable bed with a portion of the inflatable bed cut away.

The present disclosure provides an assembly 4 (with alternative embodiments also shown as 4' and 4") having a pump 2 that is disposed within a main inflatable air chamber 14 of an inflatable bed 1. The pump 2 is recessed within the inflatable chamber 14 and is coupled a connecting assembly 3, which in turn is connected to a user interface 23 welded or otherwise fixed to peripheral panel 13 of inflatable bed 1. The connecting assembly 3 is configured to convey air to and from pump 2 and exterior user interface 32, and also includes support device 7 which transfers the weight of pump 2 to portions of the inflatable bed 1 other than the peripheral panel 13, such as the upper or lower sheets 11, 12. In this way, connecting assembly 3 reduces the strain applied to the peripheral panel 13 of the inflatable chamber 14. This promotes the structural integrity and longevity of the inflatable bed 1.

Figure 2:
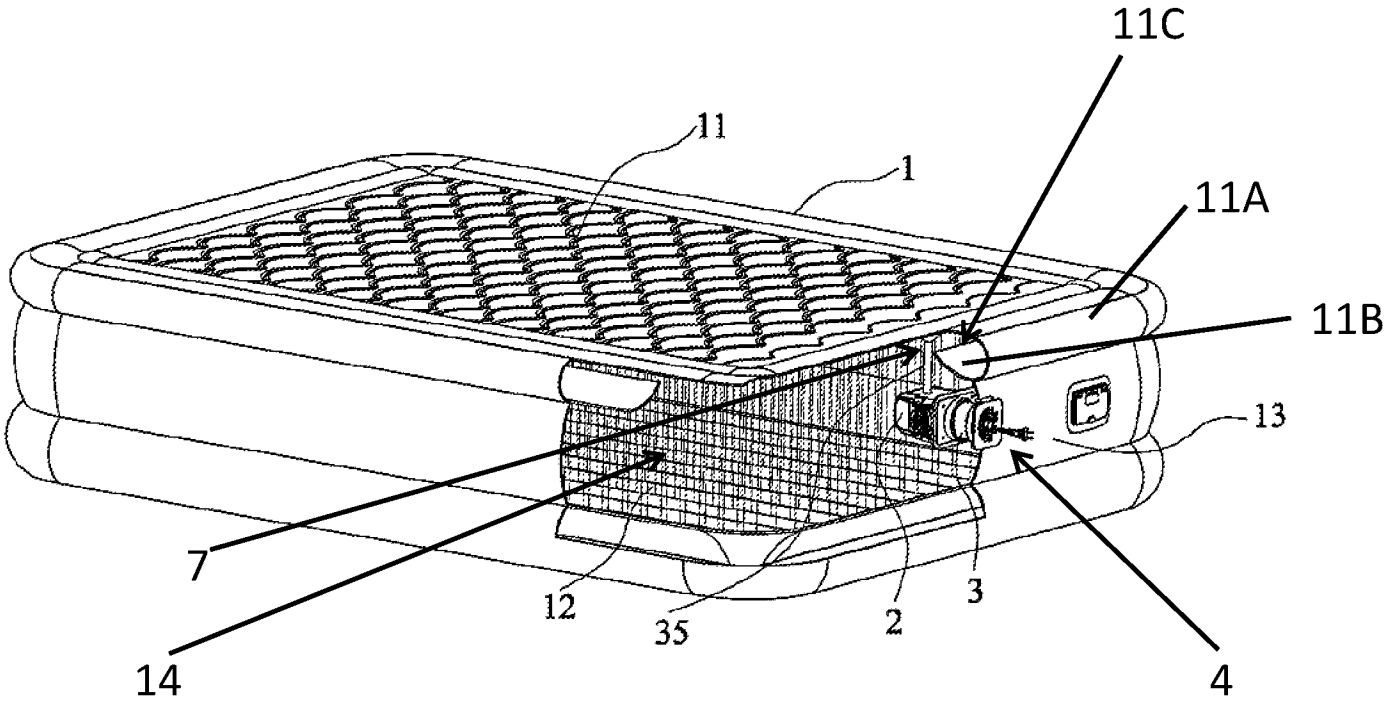
FIG. 2 is a perspective view of an alternate embodiment of the inflatable bed of FIG. 1 with a portion of the inflatable bed cut away.

Referring first to FIGS. 1 and 2, an inflatable bed 1 is shown. The inflatable bed 1 comprises an upper sheet 11, a lower sheet 12 spaced from the upper sheet 11 to form a gap therebetween, and a side wall or peripheral panel 13 coupling upper sheet 11 and lower sheet 12 and spanning the gap. Upper sheet 11, lower sheet 12, and peripheral panel 13 cooperate to define an inflatable chamber 14. Inflatable bed 1 further comprises an inflation pump 2 recessed within inflatable chamber 14 of inflatable bed 1 and a connecting assembly 3 that connects to inflatable bed 1 and to inflation pump 2, as further described below.

In the illustrated embodiment, upper sheet 11 includes an upper layer 11A, a lower layer 11B, and an air chamber 11C disposed between upper layer 11A and lower layer 11B. Upper layer 11A, lower layer 11B, and air chamber 11C enhance the comfort level of the inflatable bed 1 by providing additional cushioning to a user that is positioned on top of upper sheet 11. Lower sheet 12 may have the same structure as upper sheet 11 (i.e., panels with an air chamber disposed between the panels). In alternative embodiments, both upper sheet 11 and lower sheet 12 may be single-layer structures or may have other multilayer constructions, as required or desired for a particular application.

Figure 3:
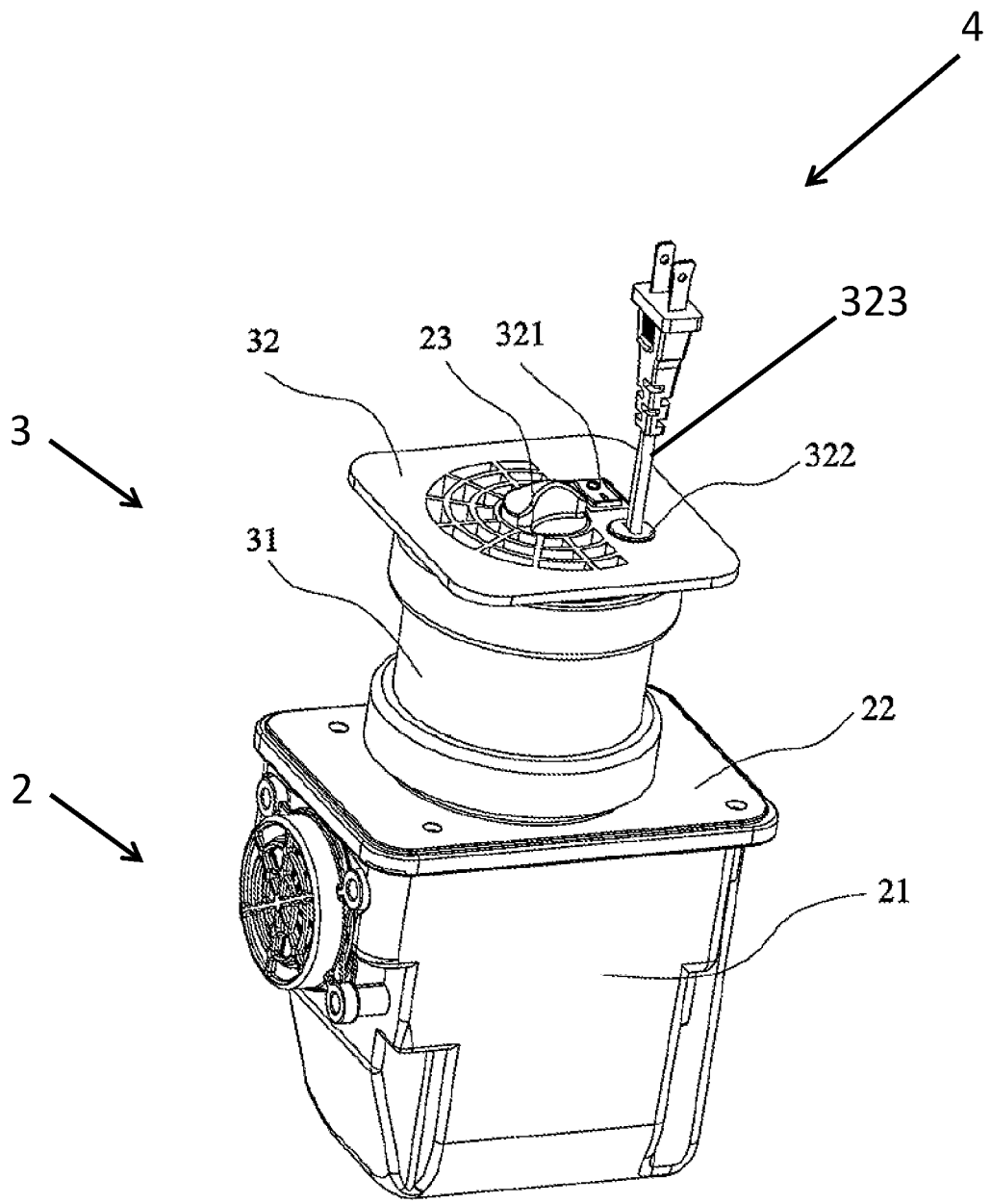
FIG. 3 is a perspective view of an inflation pump suitable for use in the inflatable beds of FIGS. 1 and 2.
Figure 4:
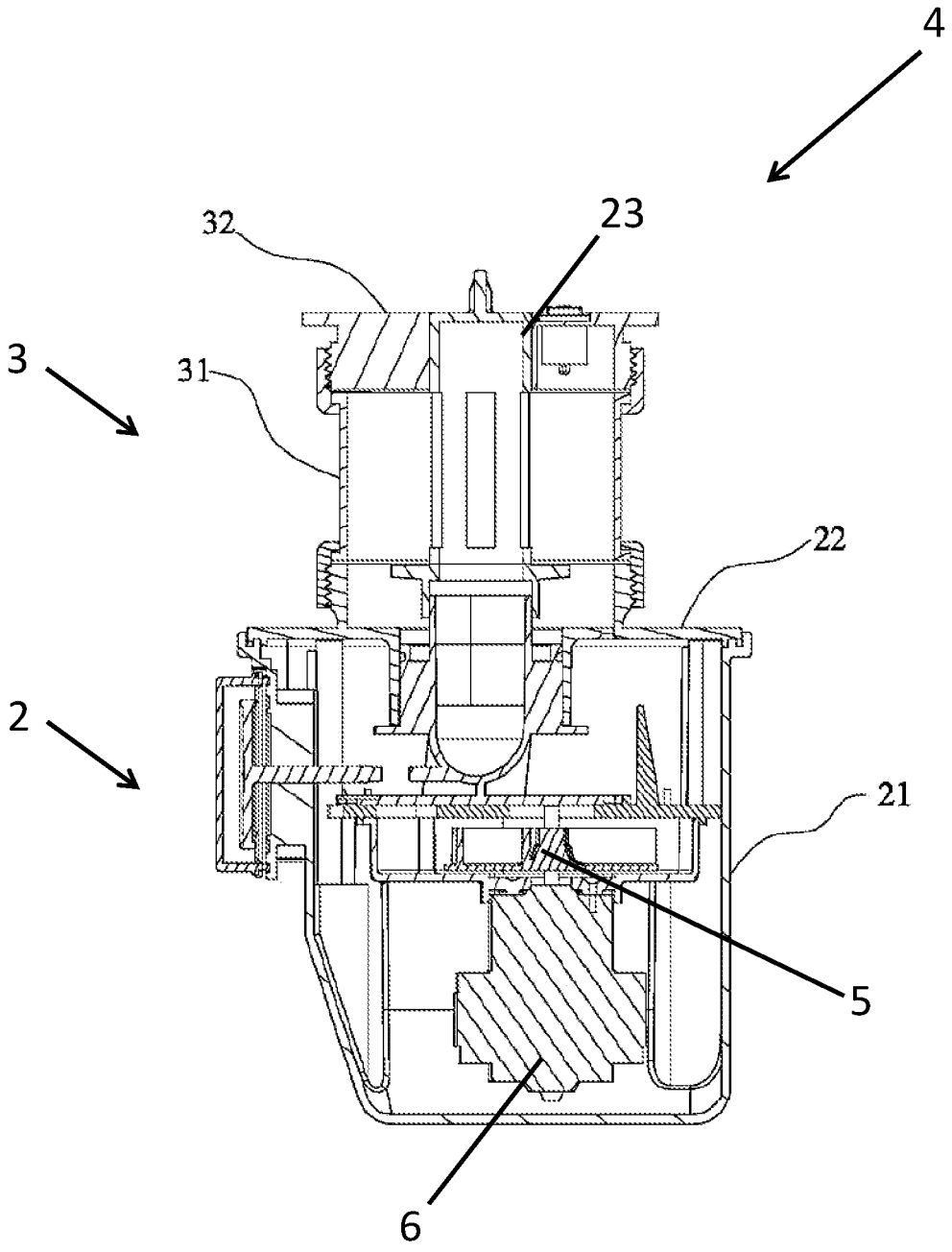
FIG. 4 is a cross sectional view of the inflation pump of FIG. 3.
Figure 5:
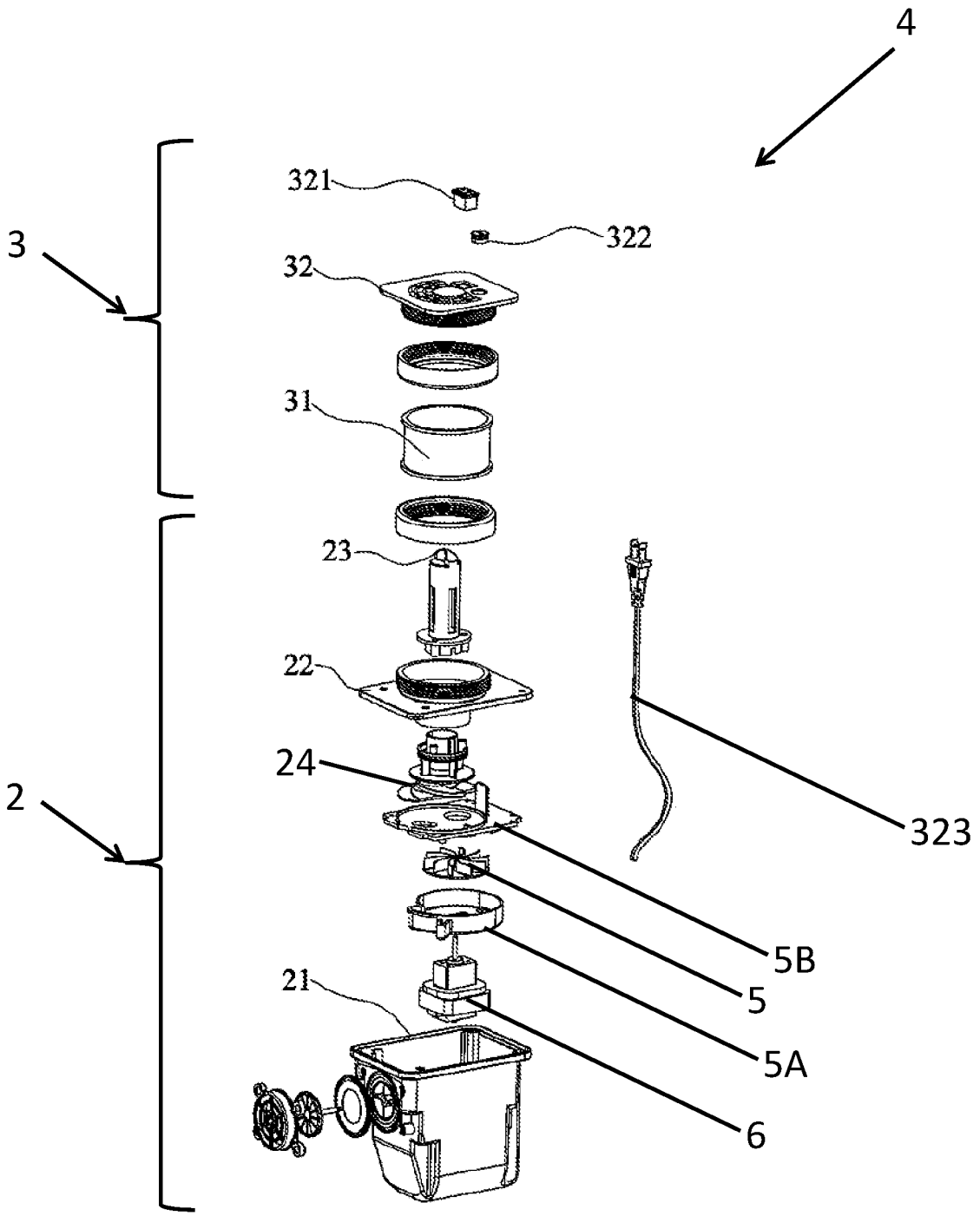
FIG. 5 is an exploded view of inflation pump of FIG. 3.

FIGS. 1 to 5 disclose a first embodiment of assembly 4 comprising an inflation pump 2 coupled to connecting assembly 3. Inflation pump 2 includes a housing 21 and an upper cover 22 coupled to housing 21. Housing 21 contains the components of pump 2, including motor 6 and fan 5, which is selectively driven by motor 6 to convey air between the ambient area outside inflatable bed 1 and the interior of inflatable chamber 14. As best seen in FIG. 5, fan 5 may be supported within a fan housing 5A and substantially enclosed by fan housing cover 5B.

Connecting assembly 3 shown in FIGS. 3-5 includes a straight spacer tube 31 and a support device 7 (FIGS. 1 and 2), which interface with user interface 32 as described herein. Together, these structures act to substantially isolate the weight of assembly 4 from peripheral panel 13, shifting such weight onto support device 7 and upper sheet 11, as described in further detail below. Connecting assembly 3 may further include components which enable the use of pump 2 by operation of user interface 32, such as switch 321, corded plug 323, and inflate/deflate control knob 23 (FIG. 6), as also described below.

As best shown in FIGS. 1 and 2, spacer tube 31 provides a gap between the pump 2 and user interface 32. An outer end of straight spacer tube 31 is threadably connected to user interface 32, while the inner end of straight spacer tube 31 is threadably connected to upper pump cover 22 of inflation pump 2. However, it is within the scope of the present disclosure that other suitable connections between straight spacer tube 31 and user interface 32 and upper pump cover 22 may be used (e.g., fasteners, welding, adhesives, collars, clamps, gaskets, or any other substantially fluid-tight attachment).

Figure 6:
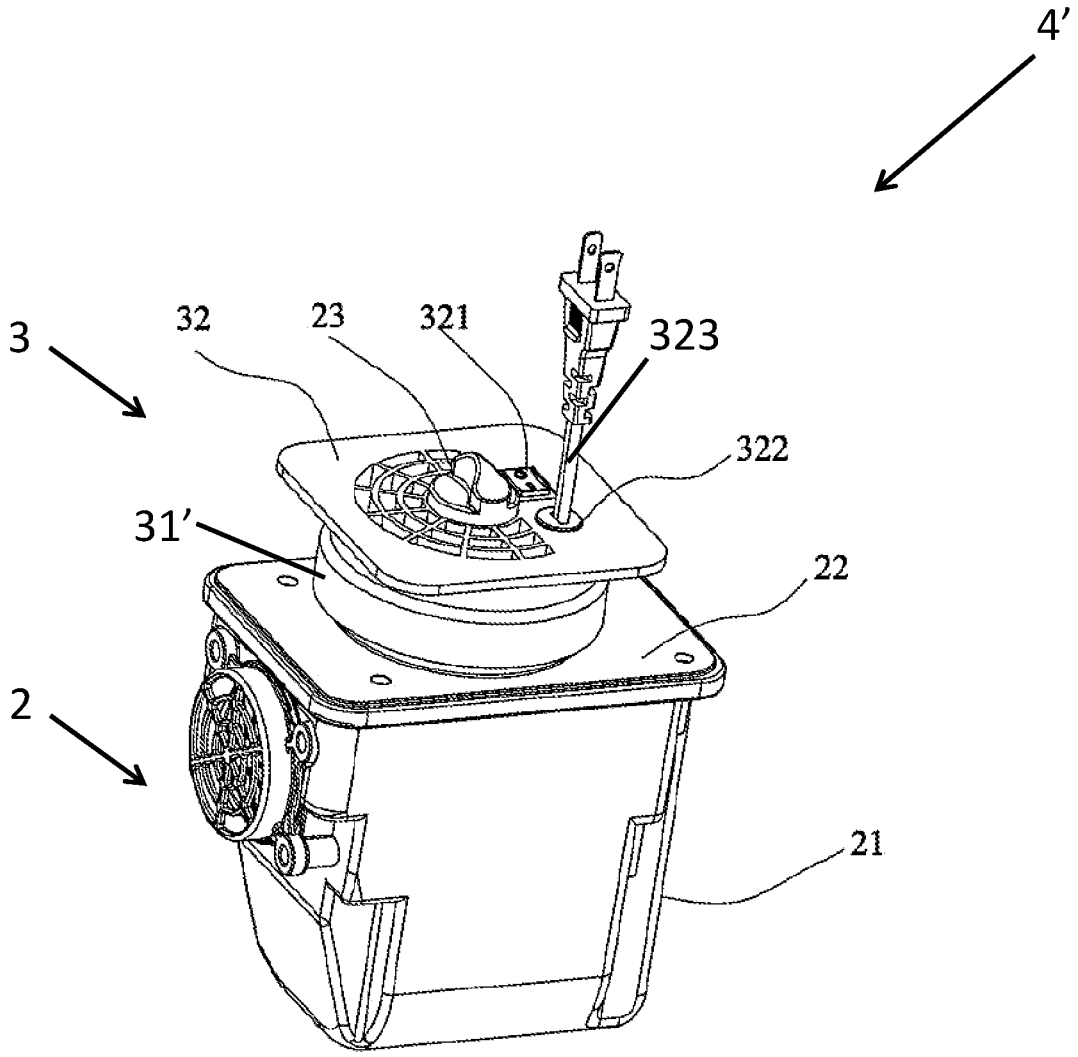
FIG. 6 is a perspective view of an alternate embodiment of the inflation pump of FIG. 3.

Spacer tube 31 also provides an air pathway between pump 2 and the ambient air around inflatable bed 1. Further, spacer tube 31 has an inflate/deflate control knob 23 connected thereto, which extends into the interior of housing 21 of inflation pump 2. Knob 23 may be rotated to impart a corresponding rotation to airflow selector 24 (FIG. 7), which may selectively align airflow selector 24 with one of two apertures formed in fan housing cover 5B (FIG. 5). This alignment configures pump 2 into inflate or deflate modes by shifting the air pathway engaged by fan 5. Spacer tube 31 may also provide a pathway for a portion of the cord of corded plug 323 (FIGS. 5 and 6).

User interface 32 is welded or otherwise fused in a fluid-tight manner (e.g., fasteners, clips, etc.) to peripheral panel 13 of inflatable bed 1. User interface 32 includes switch 321, which is electrically connected to motor 6 of pump 2 and operable to switch fan 5 into an "on" configuration to thereby activate inflation pump 2, and an "off" configuration in which fan 5 does not rotate and inflation pump 2 is thereby inactive. An air grille is formed in user interface 32, as shown, in order to allow air to be drawn inwardly through spacer tube 31 and pump 2 to inflatable chamber 14 when pump 2 is "on" and inflate/deflate control knob 23 is in inflate mode. Similarly, air discharges from inflatable chamber 14 via grille in user interface 32 when pump 2 is "on" and inflate/deflate control knob 23 is in deflate mode.

User interface further includes the outer, user-operable portion of inflate/deflate control knob 23, which can be rotated by the user to switch between configurations of inflate/deflate control knob 23 as described herein. A power connector, in the form of a corded plug 323 adapted to be connected to an external power source, passes through a fluid-tight clamp 322 connected to user interface 32.

Turning to FIGS. 1 and 2, support device 7 of connector assembly 3 is coupled at its upper end to upper sheet 11 and at its lower end to inflation pump 2. Exemplary support devices 7 include a tension belt 34 as shown in FIG. 1 (e.g., made of PVC) and a tension rope 35 as shown in FIG. 2. Tension belt 34 (FIG. 1) has opposing ends that are coupled (e.g., by welding) to upper sheet 11, with a body of belt 34 forming a U-shaped structure between the opposing ends which wraps around housing 21 and thereby functions to hold inflation pump 2 in a substantially fixed position within inflatable chamber 14 when inflatable mattress 1 is inflated. Tension rope 35 (FIG. 2) is similarly coupled to upper sheet 11 at its upper end (e.g., via a connection point welded or otherwise attached to upper sheet 11) and to housing 21 at its lower end, such that pump 2 is similarly held in a substantially fixed position within inflatable chamber 14 when inflatable mattress 1 is inflated.

In an exemplary embodiment, support device 7 (e.g., tension belt 34 or tension rope 35) is connected to the lower layer 11B of the upper sheet 11. In use, the multilayer structure of upper sheet 11 provides additional support to support device 7 such that when the weight of inflation pump 2 is transferred to lower layer 11B via support device 7, upper sheet 11 and the support device will not collapse or form a concavity in the sleeping surface of upper layer 11A. Moreover, air chamber 11C provides a buffer between the sleeping surface of upper layer 11A and the attachment point on lower layer 11B, such that the presence of support device 7 will not be detectable to a user of inflatable bed 1.

Thus, support device 7 supports the weight of inflation pump 2 primarily via upper sheet 11, rather than peripheral panel 13 and inflatable bed 1. This support provided by support device 7 assists in preventing undue stress or damage to peripheral panel 13 caused by the weight of inflation pump 2, while still allowing the user interface 32 and air intake to be applied to peripheral panel 13. That is, the weight of inflation pump 2 is distributed on support device 7 which transfers the weight to upper sheet 11, such that support device 7 reduces the amount of strain applied onto peripheral panel 13 thereby reducing stresses at the interface between peripheral panel 13 and user interface 32. In this way, damage or separation at such interface is prevented. A potential source of leak development in inflatable beds with integrated pumps is thereby eliminated, such that the service life of inflatable bed 1 can effectively be extended. In addition, distribution of the weight of inflation pump 2 on support device 7, and the location of pump 2 within air chamber 14 and spaced away from user interface 32, reduces the noise of inflation pump 2 during inflation or deflation operations.

Figure 7:
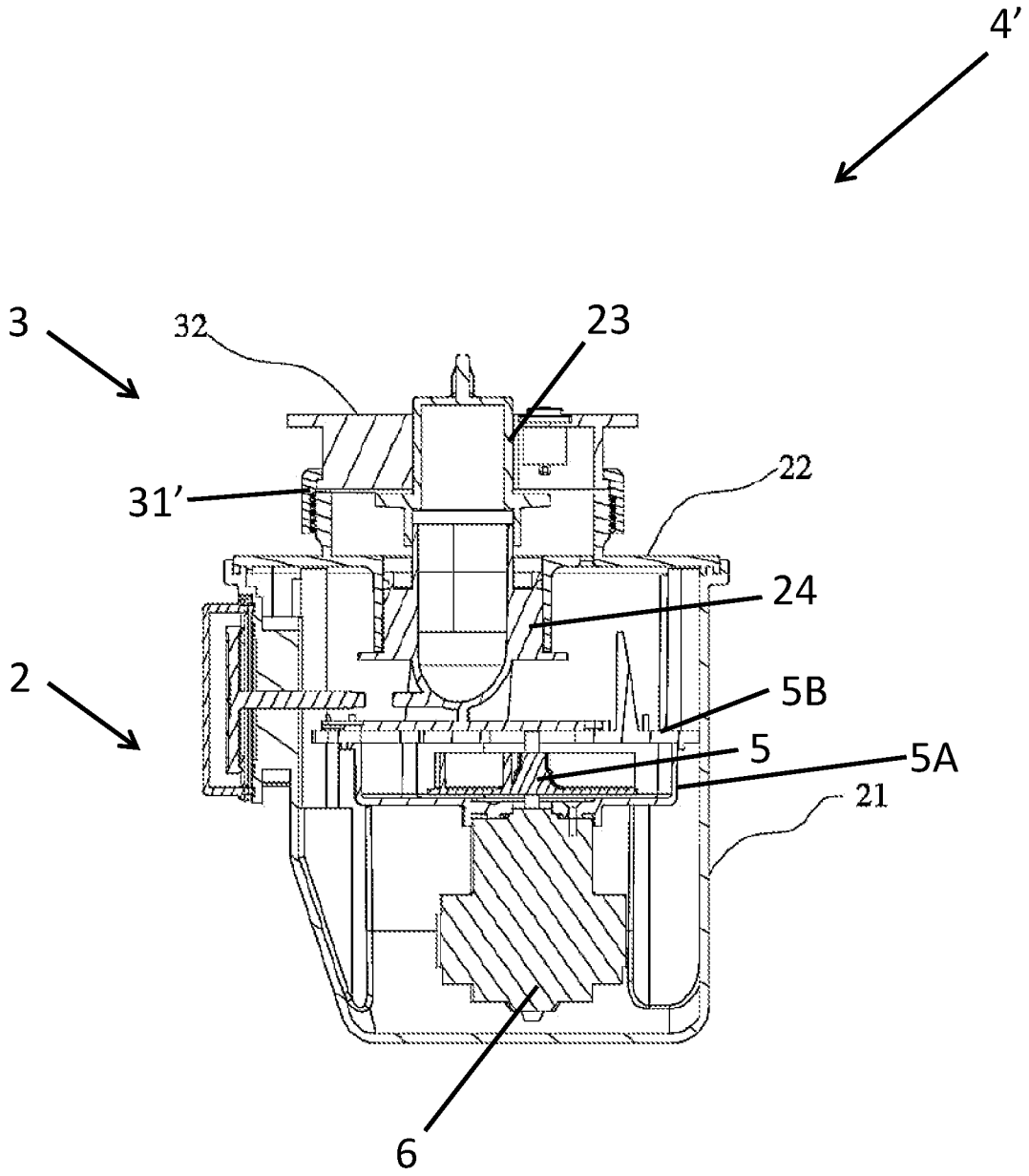
FIG. 7 is a cross sectional view of the inflation pump of FIG. 6.
Figure 8:
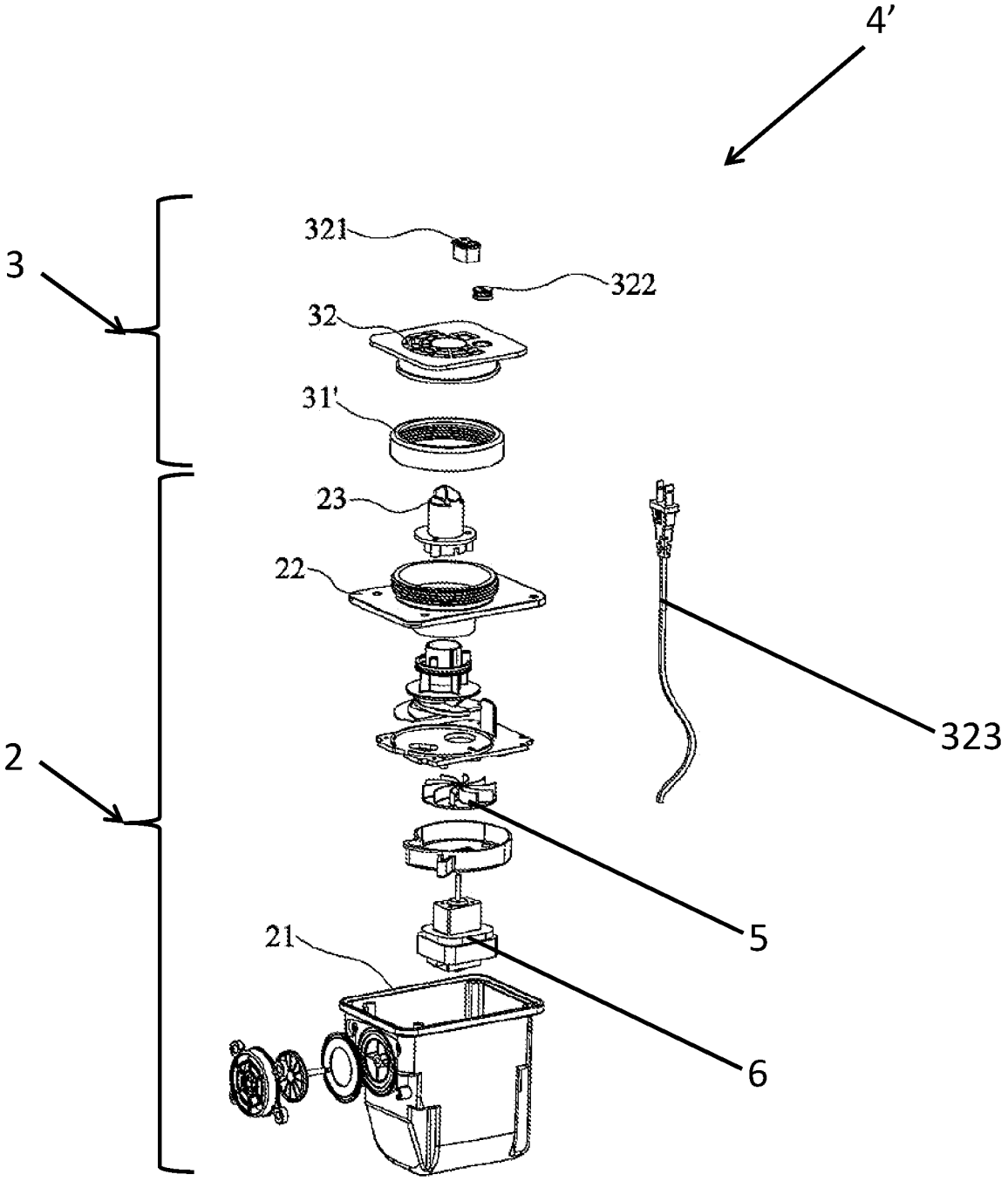
FIG. 8 is an exploded view of inflation pump of FIG. 6.

Referring now to FIGS. 6-8, an alternate embodiment of assembly 4' is shown and includes inflation pump 2 and connecting assembly 3. Assembly 4' has a similar structure as assembly 4, and analogous structures used in both designs have common functions and common reference numbers, except as otherwise specifically designated herein.

However, assembly 4' differs from assembly 4 in that connecting assembly 3 comprises a nut 31' in place of spacer tube 31. As best shown in FIG. 7, user interface 32 has an inner flange engaged by a corresponding flange formed on an outer end of nut 31'. The inner portion of nut 31' is threadably engaged with the correspondingly threaded male extension formed in cover 22. As nut 31' is tightened into cover 22, the inner surface of user interface 32 is drawn tight against the abutting outer surface of the extension formed on cover 22 (as shown in FIG. 7), such that user interface 32 forms a fluid-tight connection with upper pump cover 22 via nut 31'. As compared to spacer tube 31, nut 31' is shorter and uses less material, such that nut 31' can be employed to provide a more compact assembly 4', which in turn, reduces its weight and any associated strain applied onto peripheral panel 13.

Referring now to FIGS. 9-12, a further alternate embodiment of inflatable bed 1 is shown including assembly 4". Assembly 4" has similar structures and functions as assemblies 4, 4', and analogous structures used in both designs have common functions and common reference numbers, except as otherwise specifically designated herein.

Assembly 4" includes inflation pump 2 threadably coupled to bent spacer tube 33 of connecting assembly 3 via pump cover 22, in a similar fashion to assembly 4 described in detail above with respect to straight spacer tube 31. A user interface 32, also described above, is threadably coupled to a bent spacer tube 33. In the illustrated embodiment, bent spacer tube 33 forms a 90 degree bend such that the longitudinal axis of the inner end (i.e., the end attached to pump cover 22) is perpendicular to the longitudinal axis of the outer end (i.e., the end attached to user interface 32). However, it is contemplated that in alternate embodiments, other suitable degree turns may be used. Although threaded engagement is used to create a fluid tight connection between the respective ends of spacer tube 33 and user interface 32 and upper pump cover 22 of inflation pump 2, it is within the scope of the present disclosure that alternate coupling methods and structures may be used as required or desired, as discussed above with respect to assembly 4.

Figure 11:
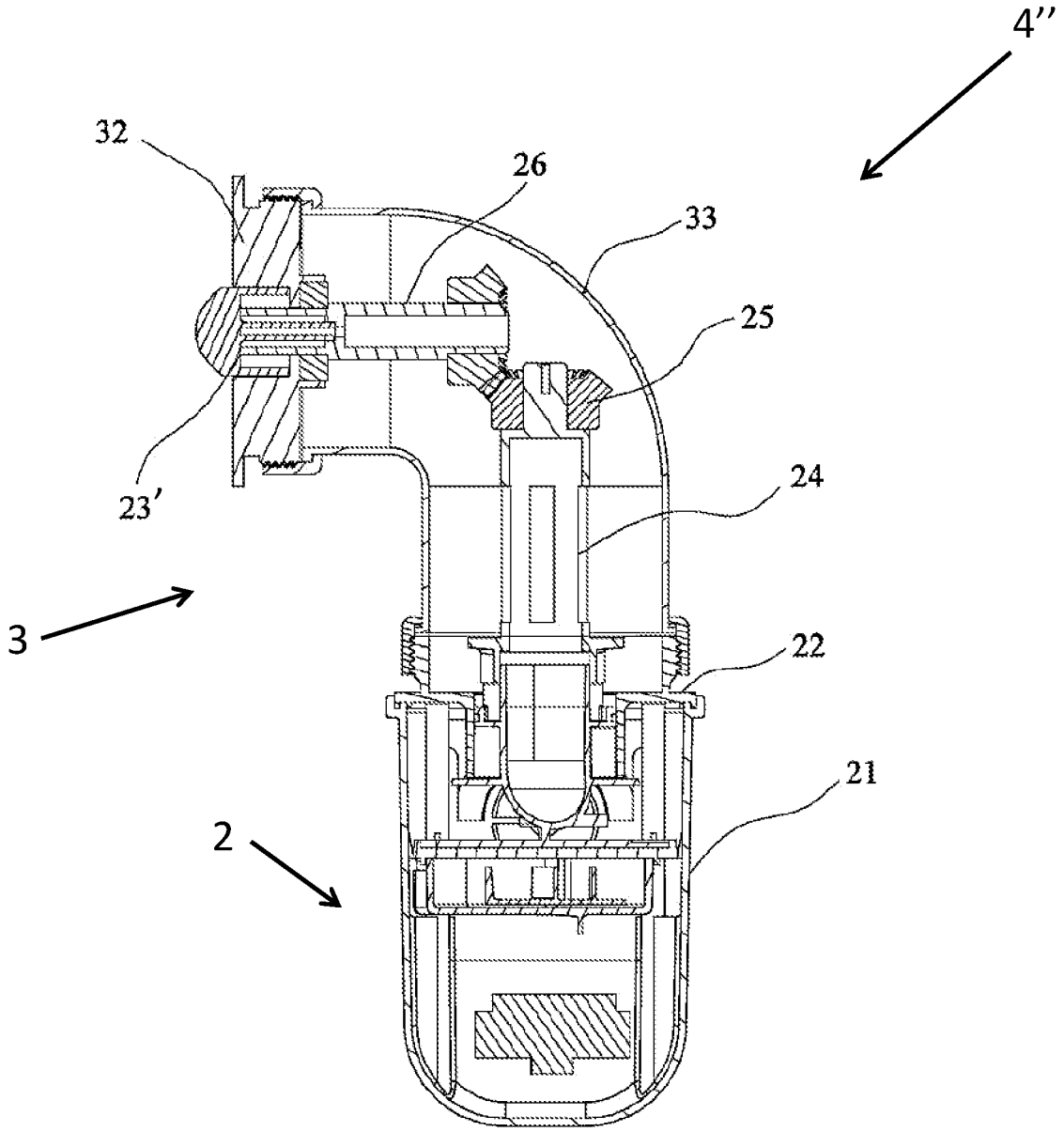
FIG. 11 is a cross sectional view of the inflation pump of FIG. 10.
Figure 12:
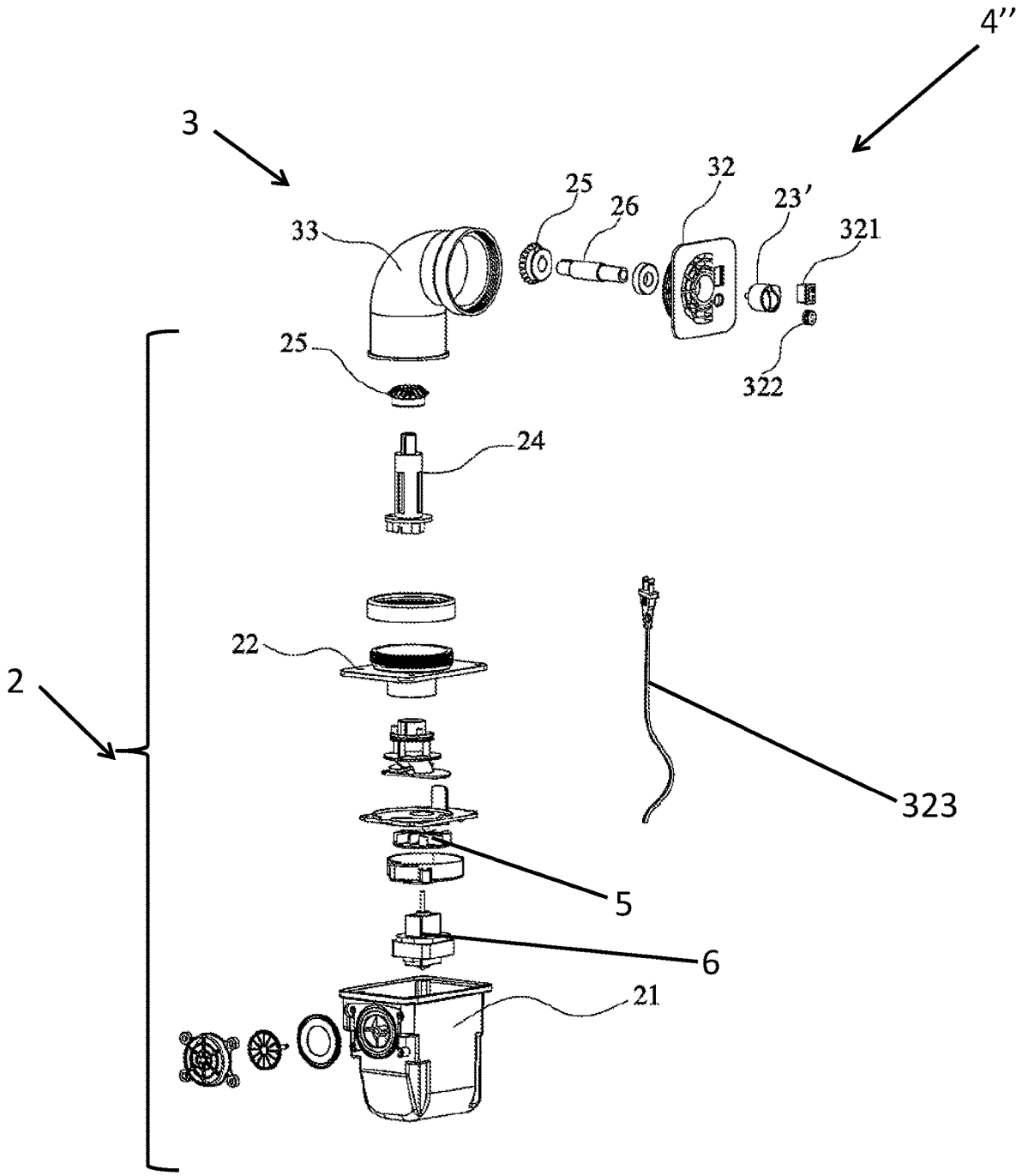
FIG. 12 is an exploded view of inflation pump of FIG. 10.

Referring to FIG. 11, spacer tube 33 contains inflate/deflate control knob 23' which is operably connected to airflow selector 24 via a connecting rod 26 and a conical gear 25. Inflate/deflate control knob 23' is coupled to user interface 32 and can be rotated by the user of the inflatable bed 1, similar to inflate/deflate control knob 23 described above with respect to assembly 4 (FIG. 3). As inflate/deflate control knob 23' is rotated, connecting rod 26 transmits the rotation to conical gear 25, which in turn transmits the rotation to airflow selector 24. In this manner, inflate/deflate control knob 23' can be used to switch pump 2 between inflation and deflation modes as described above with respect to inflate/deflate control knob 23, even though the axis of rotation of inflate/deflate control knob 23' is skewed with respect to the axis of rotation of airflow selector 24.

Figure 9:
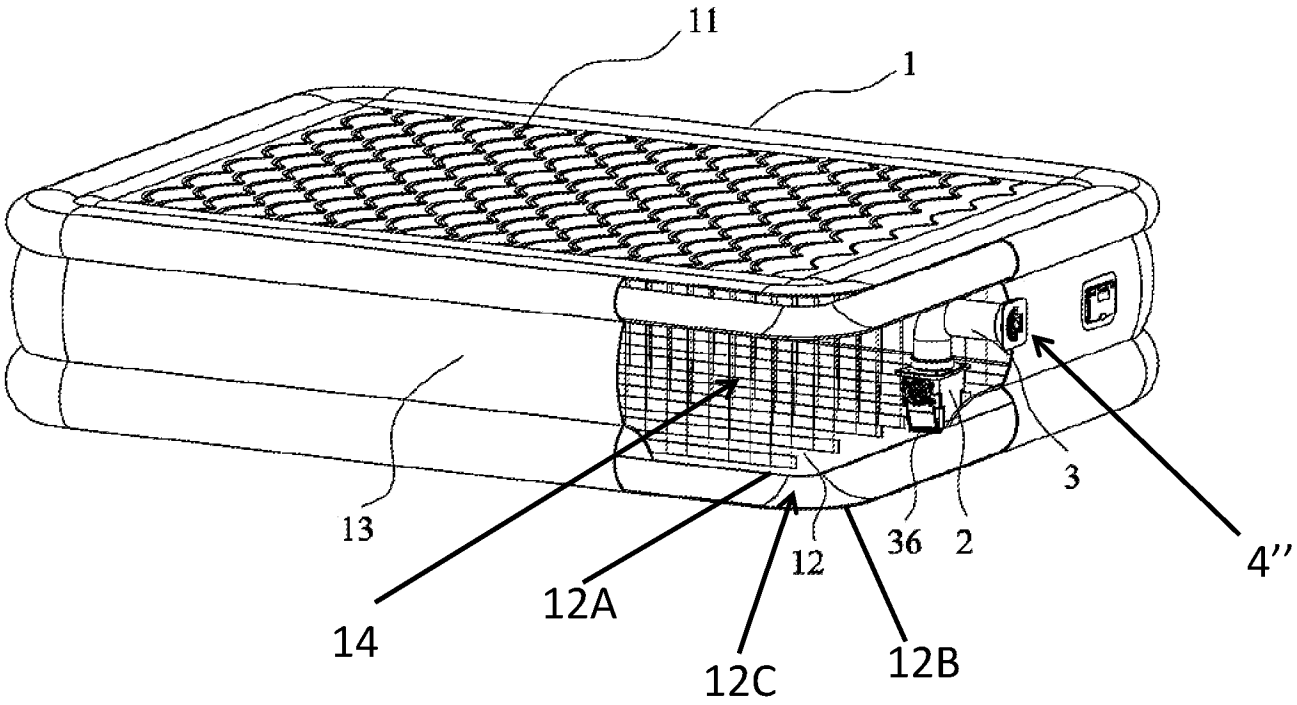
FIG. 9 is a perspective view of an alternate embodiment of the inflatable bed of FIG. 1 with a portion of the inflatable bed cut away.
Figure 10:
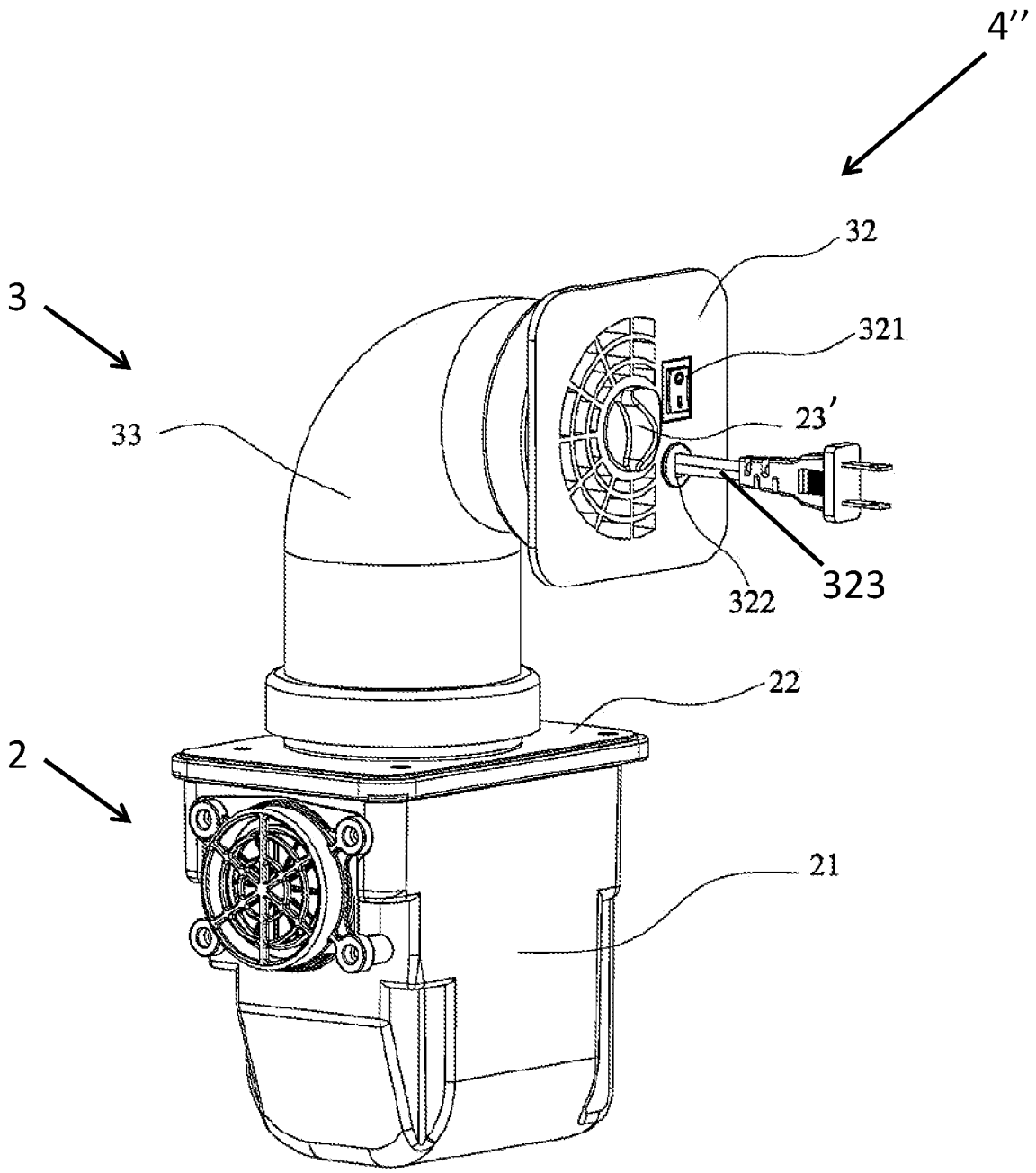
FIG. 10 is a perspective view of an alternate embodiment of the inflation pump of FIG. 3 suitable for use in the inflatable bed of FIG. 9.

As shown in FIG. 9, inflation pump 2 is disposed on lower sheet 12. Similar to upper sheet 11 as previously described, lower sheet 12 of the inflatable bed 1 can have a double-layer structure. That is, lower sheet 12 comprises an upper layer 12A and a lower layer 12B with an air chamber 12C between the upper and lower layers 12A, B.

Inflation pump 2 is flexibly but firmly coupled to upper layer 12A of lower sheet 12 so that inflation pump 2 is supported from underneath within air chamber 14 of inflatable bed 1. In one embodiment, inflation pump 2 is fixed to lower sheet 12 via an adhesive 36 (e.g., tape), which ensures the stability of the connection between inflation pump 2 and inflatable bed 1 during use, transport and storage. However, it is within the scope of the present disclosure that other coupling means may be used, such as fasteners, couplers, etc. Similar to assemblies 4, 4' described above, supporting the weight of pump 2 on lower sheet 12 avoids undue stress upon, and potential damage to, peripheral panel 13. Further, the fixed connection between pump 2 and lower sheet 12 avoids relative movement therebetween, thereby avoiding damage to lower sheet 12 due to the friction between inflation pump 2 and lower sheet 12. In this way the arrangement of assembly 4" extends the service life of inflatable bed 1. Furthermore, the weight of inflation pump 2 is distributed about lower sheet 12, and pump 2 is disposed within air chamber 14, such that noise during inflation or deflation of inflatable bed 1 is reduced.

For all three assemblies 4, 4', 4", user interface 32 is welded on to peripheral panel 13 of inflatable bed 1 and includes switch 321 to activate inflation pump 2, and includes corded plug 323 and an air grille as also described above with respect to assembly 4. In this way, assemblies 4, 4' and 4" are visually indistinguishable from the user's perspective when inflatable bed 1 is inflated.

To produce inflatable bed 1 with assembly 4, 4', or 4", user interface 32 is welded to peripheral panel 13, and inflation pump 2 is then connected to user interface 32 through spacer tubes 31 or 33, or through nut 31'. Advantageously, this production modality simplifies the process since welding user interface 32 to the adjacent peripheral panel is simpler than welding an entire pump assembly to such peripheral panel. Once the user interface 32 is in place, inflation pump 2 is connected to connecting assembly 3, which in turn is connected to peripheral panel 13 of inflatable bed 1 as described in detail herein with respect to the various embodiments of FIGS. 1-12. To disassemble assembly 4, 4', or 4", inflation pump 2 can be detached from the connection point between spacer tube 31 or 33 (or nut 31') and upper pump cover 22, or at the connection point between spacer tube 31 or 33 (or nut 31') and user interface 32, and then removed from the inflatable chamber 14 of inflatable bed 1. Thus, if problems are detected in inflation pump 2 after assembly and connection of inflation pump 2 to peripheral panel 13, a user can easily remove, disassemble, and replace inflation pump 2. This is a simpler remedy than removing a welded-on pump assembly.

Although the present disclosure is made in the context of inflatable bed 1, it is contemplated that other inflatable structures may also be used in conjunction with assemblies 4, 4' and 4". Any inflatable product with a pump integrated into the inflatable chamber thereof may benefit from the present designs. Examples of such products include inflatable spas, inflatable furniture items such as chairs and sofas, and the like.

While this invention has been described as having exemplary designs, the present disclosure can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An inflatable product assembly comprising:

an inflatable product having a pair of spaced-apart panels and a peripheral panel joining the spaced-apart panels;

an assembly comprising:

an inflation pump recessed within the inflatable product, the inflation pump including a housing containing a motor and a fan, wherein the entire housing of the inflation pump is spaced inwardly away from the peripheral panel; and a connecting assembly coupled to the inflation pump at a location inward of the peripheral panel and to the peripheral panel, the connecting assembly defining an air pathway between the inflation pump and a vent in communication with the surrounding environment; and a support device coupled to one of the pair of spaced-apart panels and coupled to the inflation pump, the support device configured to support at least a portion of the weight of the inflation pump.

2. The inflatable product assembly of claim 1, wherein the pair of spaced-apart panels comprise upper and lower sheets, and the support device is a tension belt having a pair of ends fixed to the upper sheet and a body wrapped around the inflation pump in a U-shaped configuration.

3. The inflatable product assembly of claim 1, wherein the pair of spaced-apart panels comprises upper and lower sheets, and the support device is a tension rope coupled to the upper sheet and the inflation pump.

4. The inflatable product assembly of claim 1, wherein the pair of spaced-apart panels of the inflatable product comprise:

an upper sheet including an upper layer, a lower layer and an air chamber defined between the upper layer and the lower layer; and a lower sheet spaced from the upper sheet and joined to the upper sheet via the peripheral panel.

5. The inflatable product assembly of claim 4, wherein the inflation pump is supported by the lower layer of the upper sheet via the support device.

6. The inflatable product assembly of claim 5, wherein the support device is a tension belt having a pair of ends fixed to the upper sheet and a body wrapped around the inflation pump in a U-shaped configuration.

7. The inflatable product assembly of claim 5, wherein the support device is a tension rope coupled to the upper sheet and the inflation pump.

8. The inflatable product assembly of claim 1, wherein the inflatable product assembly is an inflatable bed.

9. An inflatable product assembly comprising:

an inflatable product comprising a lower sheet, an upper sheet spaced from the lower sheet, and a peripheral panel joining the upper and lower sheets to define a main air chamber, the lower sheet including an upper layer, a lower layer, and a secondary air chamber defined between the upper layer and the lower layer;

an assembly comprising:

an inflation pump coupled to the upper layer of the lower sheet and recessed within the main air chamber, the inflation pump including a housing containing a motor and a fan, wherein the entire housing of the inflation pump is spaced inwardly away from the peripheral panel; and a bent connecting assembly coupled to the inflation pump at a first end located inward of the peripheral panel and extending outwardly toward the peripheral panel at a second end opposite the first end, the bent connecting assembly defining an air pathway between the inflation pump and a vent in communication with the surrounding environment.

10. The inflatable product assembly of claim 9, wherein the bent connecting assembly comprises a spacer tube having a 90 degree bend.

11. The inflatable product assembly of claim 9, wherein the upper sheet comprises an upper layer, a lower layer and an additional secondary air chamber positioned between the upper layer and the lower layer.

12. The inflatable product assembly of claim 11, wherein the bent connecting assembly is coupled to a user interface, and the user interface is coupled to the peripheral panel.

13. The inflatable product assembly of claim 9, wherein the inflatable product assembly is an inflatable bed.

14. An inflatable product assembly, comprising:

an inflatable product including:

an upper sheet;

a lower sheet; and a peripheral panel coupling the upper sheet and the lower sheet and defining an inflatable chamber;

an assembly comprising:

an inflation pump recessed within the inflatable chamber, the inflation pump including a housing containing a motor and a fan, wherein the entire housing of the inflation pump is spaced inwardly away from the peripheral panel; and a connecting assembly coupled to the inflation pump at a location inward of the peripheral panel and coupled to the peripheral panel of the inflatable product, the connecting assembly defining an air pathway between the inflation pump and a vent in communication with the surrounding environment.

15. The inflatable product assembly of claim 14, wherein the upper sheet includes an upper layer, a lower layer, and a secondary air chamber positioned between the upper layer and the lower layer.

16. The inflatable product assembly of claim 15, wherein the connecting assembly further includes a support device coupled to the lower layer of the upper sheet and configured to support at least a portion of the weight of the inflation pump.

17. The inflatable product assembly of claim 16, wherein the support device is a tension belt having a pair of ends fixed to the upper sheet and a body wrapped around the inflation pump in a U-shaped configuration.

18. The inflatable product assembly of claim 16, wherein the support device is a tension rope coupled to the upper sheet and the inflation pump.

19. The inflatable product assembly of claim 14, wherein the connecting assembly comprises a spacer tube having a 90 degree bend.

20. The inflatable product assembly of claim 14, wherein the inflatable product is an inflatable bed.

21. The inflatable product assembly of claim 14, further comprising a user interface coupled to the peripheral panel and having a grille over the vent, the inflatable product assembly having:

an inflate mode in which air is directed through the grille of the user interface, through the air pathway of the connecting assembly, and through the pump to inflate the inflatable product; and a deflate mode in which air is discharged from the pump, through the air pathway of the connecting assembly, and through the grille of the user interface to deflate the inflatable product.

22. The inflatable product assembly of claim 14, wherein an actuator is positioned within the connecting assembly and extends to an airflow selector to direct airflow through the inflatable product assembly.

* * * * *